United States Patent [19]

Ohnishi

[11] Patent Number: 4,612,890

[45] Date of Patent: Sep. 23, 1986

[54] CENTRIFUGAL GOVERNOR FOR INTERNAL COMBUSTION ENGINES

[75] Inventor: Masanori Ohnishi, Higashimatsuyama, Japan

[73] Assignee: Diesel Kiki Co., Ltd., Tokyo, Japan

[21] Appl. No.: 727,282

[22] Filed: Apr. 25, 1985

[30] Foreign Application Priority Data

May 2, 1984 [JP] Japan ..... 59-64874[U]

[51] Int. Cl.[4] ..... F02M 39/00

[52] U.S. Cl. ..... 123/373; 123/179 L; 123/365; 123/372

[58] Field of Search ..... 123/365, 366, 368, 373, 123/388, 179 L, 372

[56] References Cited

U.S. PATENT DOCUMENTS

| | | | |
|---|---|---|---|
| 3,640,259 | 2/1972 | Garcea | 123/179 L |
| 3,865,091 | 2/1975 | Bostwick | 123/179 L |
| 4,143,634 | 3/1979 | Ritter | 123/179 L |
| 4,204,510 | 5/1980 | Ritter | 123/366 |
| 4,397,277 | 8/1983 | Takahashi | 123/373 |

FOREIGN PATENT DOCUMENTS

| | | | |
|---|---|---|---|
| 58-7814 | 2/1983 | Japan | 123/373 |

*Primary Examiner*—Carl Stuart Miller

*Attorney, Agent, or Firm*—Frishauf, Holtz, Goodman & Woodward

[57] ABSTRACT

A centrifugal governor for an internal combustion engine, which includes a sensor lever adapted to engage a cam surface of a torque cam determining a starting fuel increment, at the start of the engine, to displace the control rack into a fuel increasing position, and a cancelling spring interposed between the torque cam and the tension lever and urging the torque cam with a force dependent upon the angularity of the tension lever in a direction of disengaging the sensor lever from the cam surface for interrupting the starting fuel increasing action of the governor. Arranged at one end of an idling spring which urges the tension lever against radially outward movement of the flyweights is a spring force adjusting device adapted to increase the force of the idling spring at low temperatures to prohibit pivotal movement of the tension lever otherwise caused by operation of the control lever to a full-speed position at the start of the engine, thereby ensuring positive engagement of the sensor lever with the cam surface.

1 Claim, 4 Drawing Figures

CENTRIFUGAL GOVERNOR FOR INTERNAL COMBUSTION ENGINES

BACKGROUND OF THE INVENTION

This invention relates to a centrifugal governor for use with an internal combustion engine, and more particularly to a centrifugal governor of this kind which has an improved function of increasing the quantity of fuel to be supplied to the engine at the start of same.

A conventional centrifugal governor adapted to increase the fuel supply quantity at the start of the engine is known, e.g. from Japanese Patent Publication No. 58-7814, which comprises a control rack for regulating the quantity of fuel to be supplied to the engine, flyweight members radially displaceable in response to the rotational speed of the engine, a tension lever pivotable about a stationary shaft in response to the radial displacement of the flyweight members, an idling spring for urging the tension lever against radially outward displacement of the flyweight members, a torque cam having a cam surface determining a fuel increment to be applied at the start of the engine, a sensor lever having one end engaged by the control rack and another end disposed for engagement with the cam surface of the torque cam, the sensor lever being adapted to engage with the cam surface of the torque cam when the engine is in a starting condition, to cause displacement of the control rack into a fuel increasing position for the start of the engine, a cancelling spring interposed between the torque cam and the tension lever and urging the torque cam with a force dependent upon the angularity of the tension lever in a direction of disengaging the sensor lever from the cam surface of the torque cam, a control lever, and a floating lever interlocking with the control lever operable at human will and having one end engaged by the control rack and another end operatively connected with the tension lever through a guide lever. In the centrifugal governor of this type, when the control lever is operated to a full speed position in order to start the engine, the floating lever is pivotally displaced about its end engaging the guide lever to cause the control rack to be displaced to a fuel increasing position for the start of the engine. This displacement of the control rack to the starting fuel increasing position is realized by engagement of the tip of the sensor lever engaged by the control rack with the cam surface of the torque cam.

However, in cold weather, when the control lever is operated to cause displacement of the control rack to the starting fuel increasing position, the increased frictional resistance of the control rack acts upon the floating lever, which can cause pivotal displacement of the floating lever about its fulcrum engaged with the control rack to displace the guide lever, though then the control rack is also displaced to some degree by the floating lever. This causes pivotal displacement of the tension lever against the force of the idling spring counteracting the pivotal movement of the tension lever. As a result, the torque cam is pivotally displaced by the cancelling spring with its urging force increased by the pivotal displacement of the tension lever, to a position where the sensor lever cannot engage the cam surface of the torque cam, thus impeding the starting fuel increment.

SUMMARY OF THE INVENTION

It is the object of the invention to provide a centrifugal governor for use with an internal combustion engine, which is capable of prohibiting pivotal movement of the tension lever even at the start of the engine in cold weather, to obtain positive engagement of the sensor lever with the cam surface of the torque cam, thereby ensuring the starting fuel increasing action.

According to the invention, a centrifugal governor comprises spring force adjusting means arranged at one end of the idling spring and adapted to expand at low temperatures below a predetermined value and contract at high temperatures above the predetermined value, whereby the idling spring has an urging force thereof increased at a low temperature below the predetermined value to thereby prohibit pivotal movement of the tension lever counteracting the force of the idling spring.

Preferably, the spring force adjusting means comprises at least two springs. One of the two springs is formed of a thermosensitive material having a smaller spring constant at a low temperature below the predetermined value, and a larger spring constant at a high temperature above the predetermined value.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
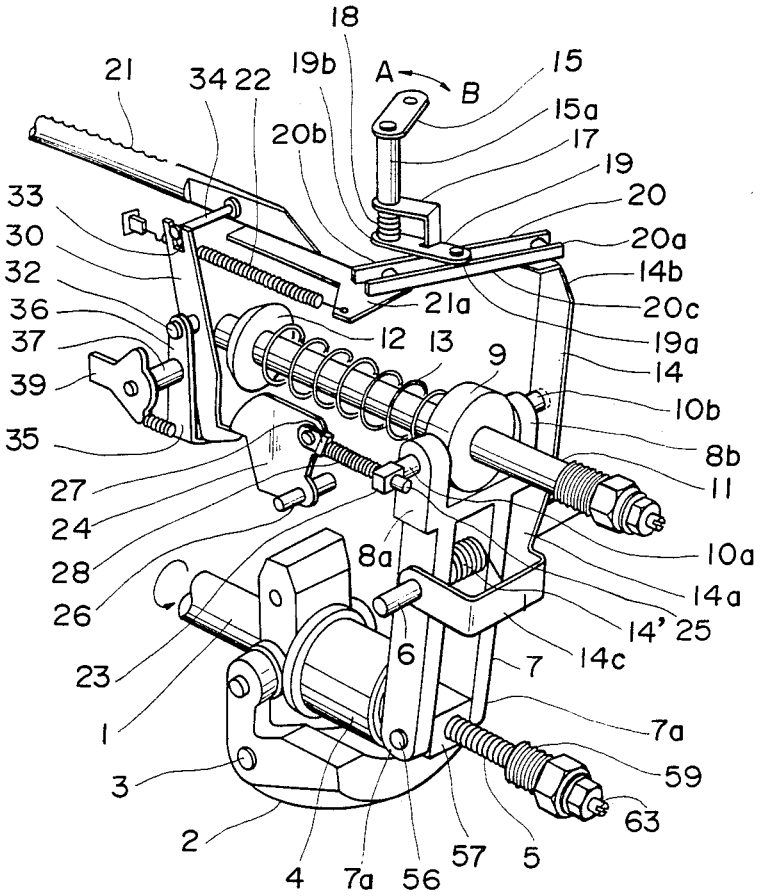
FIG. 1 is a perspective view showing the internal arrangement of a centrifugal governor according to the invention.

Referring first to FIG. 1, there is illustrated a centrifugal governor for use in a fuel injection pump, according to the present invention. A camshaft 1 of the fuel injection pump is coupled to flyweight members 2, only one of which is shown, and which are responsive to changes in the rotational speed of an engine to move radially about pins 3 supported by a flyweight holder, not shown. A sleeve 4 engages the flyweight members 2 so that it is displaced rightward as viewed in FIG. 1, along the axis of the camshaft 1 as the flyweight members 2 move radially outwardly. An idling spring 5 is interposed between a block 57 attached to a right end face of the sleeve 4 and a governor casing, not shown, to apply its force against rightward displacement of the sleeve 4, as hereinafter described in detail. Connected to the block 57 of the sleeve 4 is a lower end portion 7*a* of a tension lever 7 which is pivotably supported at its intermediate portion by a shaft 6 supported by the governor casing. A pair of brackets 8*a* and 8*b* project integrally from an upper end portion of the tension lever 7 in a manner spaced from each other, and carry pins 10*a* and 10*b*, respectively, for holding a spring seat 9 there-between. A governor shaft 11 extends through the spring seat 9 and has another spring seat 12 at its one end portion close to the flyweight members 2. A governor spring 13, formed of a coiled spring, is interposed between these spring seats 12 and 9. Thus, during operation, the tension lever 7 is displaced to a position where equilibrium is established between the force of the sleeve 4 urging the lower end portion 7*a* of the tension lever 7 in the rightward direction due to radially outward displacement of the flyweight members 2, and the combined force of the idling spring 5 and the governor spring 13 counteracting the urging force of the sleeve 4.

A guide lever 14 is pivotably supported at its lower end portion 14*a* by the tension lever shaft 6 and has an upper end 14*b* supported by a bifurcated end portion 20*a* of a floating lever 20, hereinafter referred to. An arm 14*c* extends integrally from the lower end 14*a* of the guide lever 14 at right angles thereto and parallel with the axis of the shaft 6, and is engaged by a return spring 14' disposed around the shaft 6. Thus, the guide lever 14 is pivotable about the shaft 6 in unison with the tension lever 7 with its side surface in urging contact with the pin 10*b* by the force of the return spring 14'.

The floating lever 20 engages at its other bifurcated end portion 20*b* with a base 21*a* of a control rack 21, and is pivotably supported at its intermediate portion 20*c* by one end 19*a* of a supporting lever 19. The supporting lever 19 has its other end 19*b* pivotably supported by a shaft 15*a* of a control lever 15 which in turn is supported by the governor casing. An L-shaped lever 17 is secured to the control lever shaft 15*a* for urging engagement with the supporting lever 19. The supporting lever 19 is acted upon by a return spring 18 provided at its other end 19*b* for pivotal displacement about the shaft 15*a* into urging contact with the L-shaped lever 17. When the supporting lever 19 is thus engaged with the lever 17, it is pivotally displaced in unison with the control lever 15. The control rack 21 is pulled by a starting spring 22 connected to the base 21*a* of the control rack 21, in the leftward direction as viewed in FIG. 1, i.e. in such a direction as to cause the fuel injection pump to increase the quantity of fuel to be supplied to the engine.

Figure 2:
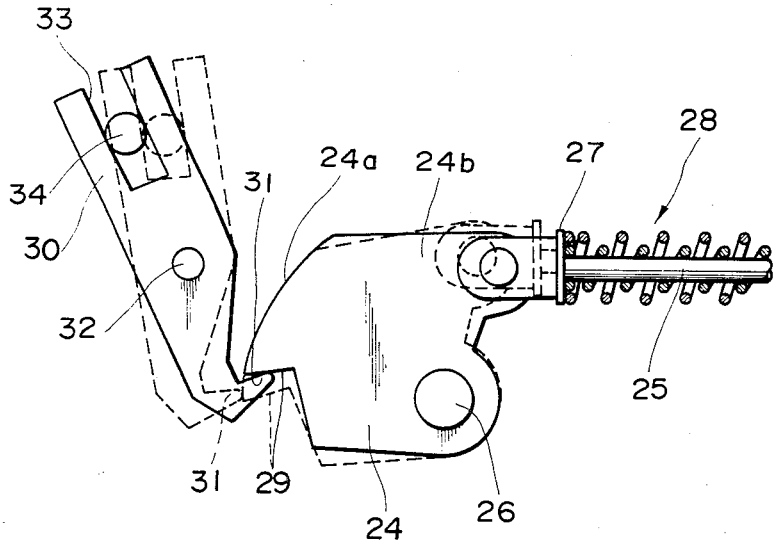
FIG. 2 is an enlarged view showing a torque cam and a sensor lever in FIG. 1, in engagement with each other.

The pin 10*a* supported by the bracket 8*a* of the tension lever 7 has an integral spring seat 23 into which one end of a rod 25 is fitted. The rod 25 has its other end pivoted to a torque cam, as shown in FIG. 2. The torque cam 24 is arranged at a location slightly lower than the rod 25 and pivotable about a pin 26 supported by the governor casing. A cancelling spring 28 is interposed between a spring seat 27 formed on the other end of the rod 25 and the spring seat 23, to urge the torque cam 24 in the counterclockwise direction.

The torque cam 24 has a cam surface 24*a* with its tip cut off to form a nose or engaging portion 29 which is engageable with an engaging tip 31 of a lower end of the sensor lever 30. The sensor lever 30 is pivotably supported by a pin 32 at its longitudinally intermediate portion and has a U-shaped groove 33 formed in its upper end portion. The groove 33 is engaged by an engaging pin 34 projecting from a side surface of the control rack 21 so that displacement of the control rack 21 causes pivotal movement of the sensor lever 30 about the pin 32. The pin 32 supporting the sensor lever 30 is in turn supported by a lever 36 which is disposed for pivotal movement in unison with a full load setting lever 39 through a shaft 37 supported by the governor casing. The full load setting lever 39 has its angular position adjusted by a full load setting screw 35. Therefore, by adjusting the full load setting screw 35, the center of pivotal movement of the sensor lever 30 can be set to a desired position to thereby set an extreme position of the control rack 21 at full load operation of the engine.

Figure 3:
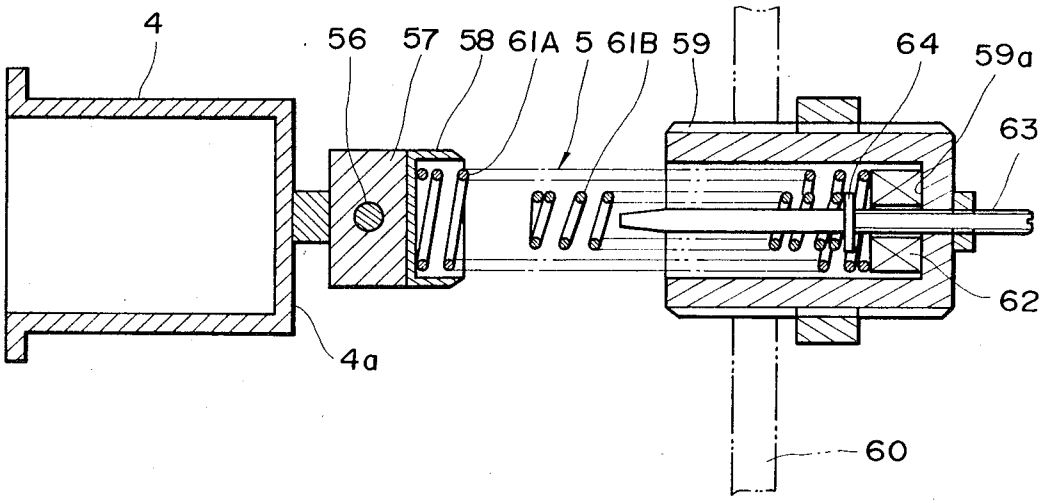
FIG. 3 is a sectional view showing an idling spring and a spring seat therefor (spring force adjusting means)

FIG. 3 illustrates in detail the arrangement of the idling spring 5 and its peripheral parts. As shown in the figure, the block 57 attached to the right end face 4*a* of the sleeve 4 carries a pin 56 transversely penetrating same, to which the tension lever 7 is pivoted. A cylindrical spring shoe 58 projects from a right end of the block 57, while another spring shoe 59 is mounted on the governor casing 60 in a fashion opposed to the spring shoe 58. The idling spring 5 is supportedly interposed between these spring shoes 58, 59, and comprises a pair of coiled springs 61A and 61B arranged in concentricity with each other. The outer spring 61A has one end urged against a bottom surface of the spring shoe 58 and another end urged against a bottom surface 59*a* of the spring shoe 59 via a spring seat or shim 62 arranged within the spring shoe 59.

A threaded shaft 63 is fitted through a substantially central portion of the bottom wall of the spring shoe 59 for axial displacement relative thereto, and has a spring seat 64 formed thereon at a portion located within the spring shoe 59. The inner coiled spring 61B has one end disposed in contact with the spring seat 64. The spring 61B, in a free state, has a smaller setting length than that of the outer coiled spring 61A so that its other end is spaced from the spring shoe 58. Thus, only when the spring shoe 58 moves close to the spring shoe 59 due to an increase in the engine rotational speed, the other end of the inner coiled spring 61B is brought into urging contact with the bottom surface of the spring shoe 58 to apply its urging force thereto. The setting load of the inner spring 61B can be adjusted by rotating the shaft 63 to thereby cause axial displacement of the spring seat 64.

Figure 4:
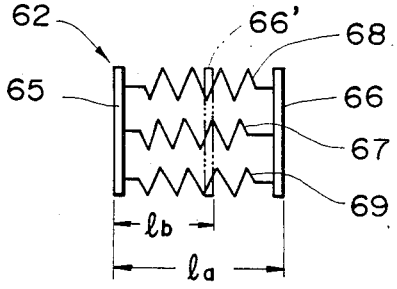
FIG. 4 is a view showing the internal arrangement of the spring seat in FIG. 3.

The spring seat 62 expands and contracts in response to changes in its own temperature, and comprises a pair of opposite end plates 65 and 66, and a plurality of, e.g. three, springs 67–69 interposed between the end plates 65, 66, as shown in FIG. 4. The spring 67 is a compression spring formed of an ordinary elastic material generally employed as a material for coiled springs and urges the end plates 65, 66 in directions away from each other. On the other hand, the springs 68, 69 are tension springs each formed of a thermosensitive material, preferably a shape memory alloy, and pulling the end plates 65, 66 in directions toward each other.

Each of the springs 68, 69 has a smaller force or smaller spring constant at a low temperature below a predetermined transformation point Tz, and a larger force or spring constant at a normal temperature above the transformation point Tz. Thus, in a low temperature condition, the expanding force of the spring 67 overcomes the combined contracting force of the springs 68, 69 so that the spring seat 62 assumes a length of 1a with the end plates 65, 66 further separated away from each other. While in a normal temperature condition, the combined contracting force of the springs 68, 69 is larger than the expanding force of the spring 67, and therefore, the spring seat 62 assumes a reduced length of 1b ($<$ 1a). Thus, the spring seat 62 has larger and smaller lengths at a low temperature and at a normal temperature, respectively.

With this arrangement, it has been ascertained that if the outer spring 61A has a spring constant of 0.05 kg/mm and a length of 65 mm in a free state, and the spring seat 62 is designed such that the spring 61A has a setting length of 55 mm at a normal temperature and 50 mm at a low temperature, the setting length being the spring length assumed at stoppage of the engine, the outer spring 61A has a setting load of 500 g at a normal temperature to provide a force of 240 g for pulling the control rack 21, which overcomes the frictional resistance of the control rack, provided that the lever ratio of the floating lever 20, the guide lever 14 and the tension lever 7 is 0.48, whereas at a low temperature condition, the outer spring 61A has a setting load of 750 g to provide an increased force of 360 g for pulling the control rack 21 by multiplying the value 750 g by the lever ratio (0.48), thus providing an increased force counteracting the frictional resistance of the control rack.

Fuel increasing action of the centrifugal governor takes place at the start of the engine, in the following manner:

First, let it be assumed that the centrifugal governor is operated in a normal temperature condition. While the engine is at rest, no centrifugal force is produced by the flyweight members 2, and accordingly the tension lever 7 is biased to a leftward position as viewed in FIG. 1, corresponding to no lifting of the flyweight members 2, by the force of the idling spring 5, etc. Therefore, the torque cam 24 is then pulled upwardly rightward by the rod 25 as shown in FIG. 2. With this governor position, if the control lever 15 is operated in a direction indicated by the arrow A in FIG. 1 to a full speed position, the supporting lever 19 is also pivotally displaced in the same direction at its one end 19*a* engaged with the floating lever 20 due to the force of the return spring 18. Since the frictional resistance of the control rack 21 is small at a normal temperature, the floating lever 20 is pivotally displaced about its one end 20*a* engaging with the upper end 14*b* of the guide lever 14, thereby moving the control rack 21 in a fuel increasing direction. On this occasion, the pin 34 projecting from the control rack 21 causes counterclockwise displacement of the sensor lever 30 about the pin 32. Since the torque cam 24 is then in the pulled-up position as stated before, the sensor lever 30 has its engaging portion 31 brought into engagement with the cut-off portion 29 formed in the tip of the torque cam 24, as indicated by the solid line in FIG. 2. Thus, the control rack 21 can be displaced to a fuel increasing position for the start of the engine, beyond the extreme position at full load operation of the engine, hereinafter referred to, which is determined by the cooperation of the torque cam 24 and the sensor lever 30. In this manner, the fuel increasing action of the governor takes place at the start of the engine.

On the other hand, when the engine is started at a low temperature, the increased frictional resistance of the control rack 21 acts upon the floating lever 20 so as to impede its pivotal displacement about its fulcrum engaging the upper end 14*b* of the guide lever 14. Therefore, the floating lever 20 can pivotally move about the end 21*a* of the control rack 21 to force the guide lever 14 leftward as viewed in FIG. 1. In the case of the conventional idling spring referred to hereinbefore, the urging force exerted upon the tension lever 7 by the guide lever overcomes the force of the idling spring to cause pivotal movement of the tension lever 7 in unison with the guide lever 14. This movement of the tension lever 7 causes the spring seat 23 to compress the cancelling spring 28 to thereby bias the torque cam 24 in the counterclockwise direction. Accordingly, the engaging portion 31 of the sensor lever 30 cannot engage the engaging portion 29 of the torque cam 24, but is brought into contact with the cam surface 24*a*. Thus, the displacement of the sensor lever 30 is limited by the torque cam 24 to a position indicated by the broken line in FIG. 2, i.e. the extreme position at full load operation of the engine, impeding movement of the control rack 21 to the starting fuel increasing position.

According to the present invention, the idling spring 5 has a larger force at a low temperature than at a normal temperature, due to expansion of the spring seat 62. Therefore, the pivotal displacement of the tension lever 7 at the start of the engine is prohibited by the increased force of the idling spring 5, to thereby hold the torque cam 24 in the pulled-up position indicated by the solid line in FIG. 2, to ensure positive engagement of the engaging portion 31 of the sensor lever 30 with the engaging portion 29 of the torque cam 24 even in a low temperature condition, for increasing the fuel quantity for the start of the engine.

The outer spring 61A and the spring seat 62 may be suitably designed so as to set the setting load of the outer spring 61A to a desired value at a low temperature. The larger the spring constant of the outer spring 61A, the more advantageous results can be obtained.

Although in the foregoing embodiment, the idling spring 5 comprises two coiled springs 61A, 61B, alternatively it may be formed of a single coiled spring.

Further, although in the illustrated embodiment, the spring seat 62 is interposed between the bottom surface 59*a* of the spring shoe 59 and the coiled spring 61A, it may alternatively be interposed between the bottom surface of the spring shoe 58 and the coiled spring 61A.

What is claimed is:

1. A centrifugal governor for use with an internal combustion engine, comprising:

a control rack for regulating the quantity of fuel to be supplied to said engine;

flyweights radially displaceable in response to the rotational speed of said engine;

a tension lever pivotable through an angle dependent upon the amount of radial displacement of said flyweights;

an idling spring for urging said tension lever against radially outward displacement of said flyweights;

a torque cam having a cam surface determining a fuel increment to be applied at the start of said engine;

a sensor lever having one end engaged by said control rack, said sensor lever having another end adapted to engage with said cam surface of said torque cam when said engine is in a starting condition, to cause displacement of said control rack into a fuel increasing position for the start of said engine;

a cancelling spring interposed between said torque cam and said tension lever and urging said torque cam with a force dependent upon the angularity of said tension lever in a direction of disengaging said sensor lever from said cam surface of said torque cam;

a control lever;

a floating lever interlocking with said control lever operable at human will and having one end engaged by said control rack and another end by said tension lever, respectively; and spring force adjusting means arranged at one end of said idling spring and adapted to expand at low temperatures below a predetermined value and contract at high temperatures above said predetermined value, whereby said idling spring has a force thereof increased at a low temperature below said predetermined value to thereby prohibit pivotal movement of said tension lever counteracting the force of said idling spring;

said spring force adjusting means comprising:

at least a first spring and a second spring, one of said first and second springs being formed of a thermosensitive material having a smaller spring constant at a low temperature below said predetermined value, and a large spring constant at a high temperature above said predetermined value; and first end plate member and a second end plate member, between which said first and second springs are interposed, said one of said first and second springs pulling said first and second end plate members in directions toward each other, the other one of said first and second springs urging said first and second end plate members in directions away from each other.

* * * * *